US006460213B1

(12) United States Patent
Flint et al.

(10) Patent No.: US 6,460,213 B1
(45) Date of Patent: Oct. 8, 2002

(54) PRECAST CONCRETE STRUCTURE HAVING LIGHT WEIGHT ENCAPSULATED CORES

(75) Inventors: John L. Flint, Livonia, NY (US); Daniel C. Hogan, Brockport, NY (US)

(73) Assignee: Concrete Precast Products Corp., Binghamton, NY (US)

( * ) Notice: Subject to any disclaimer, the term of this patent is extended or adjusted under 35 U.S.C. 154(b) by 0 days.

(21) Appl. No.: 09/633,563

(22) Filed: Aug. 7, 2000

(51) Int. Cl.[7] ..... E04C 1/00; E04B 1/74; E01D 19/12

(52) U.S. Cl. ..... 14/73; 52/309.12; 52/309.17; 52/405.1; 405/124

(58) Field of Search ..... 14/3, 4, 13, 24, 14/78, 77.1, 73; 405/124, 125; 52/309.12, 309.17, 405.1

(56) References Cited

U.S. PATENT DOCUMENTS

| | | | | | |
|---|---|---|---|---|---|
| 2,184,137 | A | * | 12/1939 | Brewer | 52/223.7 |
| 3,651,653 | A | * | 3/1972 | Mouton, Jr. | 405/252 |
| 3,671,368 | A | | 6/1972 | Shelley | |
| 3,794,433 | A | * | 2/1974 | Schupack | 404/1 |
| 3,906,067 | A | * | 9/1975 | Alspach | 264/46.5 |
| 4,186,536 | A | * | 2/1980 | Piazza | 52/309.12 |
| 4,300,320 | A | | 11/1981 | Rooney | |
| 4,564,313 | A | | 1/1986 | Niswander et al. | |
| 4,655,016 | A | | 4/1987 | Jacob | |
| 4,660,243 | A | * | 4/1987 | Kinkel | 14/17 |
| 4,841,702 | A | * | 6/1989 | Huettemann | 52/309.12 |
| 4,993,872 | A | | 2/1991 | Lockwood | |
| 5,067,298 | A | * | 11/1991 | Petersen | 52/741 |
| 5,095,674 | A | | 3/1992 | Huettemann | |
| 5,440,845 | A | * | 8/1995 | Tadros et al. | 52/309.12 |
| 5,588,272 | A | | 12/1996 | Haponski | |
| 5,737,896 | A | * | 4/1998 | Rodgers | 52/745.2 |
| 5,900,191 | A | * | 5/1999 | Gray et al. | 264/59 |
| 5,930,965 | A | | 8/1999 | Carver | |
| 6,006,480 | A | * | 12/1999 | Rook | 52/309.12 |
| 6,046,255 | A | * | 4/2000 | Gray et al. | 523/218 |
| 6,170,105 | B1 | * | 1/2001 | Doyle et al. | 14/73 |

* cited by examiner

*Primary Examiner*—Gary S. Hartmann
(74) *Attorney, Agent, or Firm*—Wall Marjama & Bilinksi LLP

(57) ABSTRACT

A precast concrete bridge system containing one or more sections wherein each section includes a horizontally disposed, load-bearing span that is integrally cast with a pair of vertical side walls. Each wall contains lightweight cores encapsulated in the concrete to create a series of longitudinally extended beams in each wall so that the beams in one wall are coaxially aligned with the beams in an adjacent wall. The cores constitute between 16–35 % of the total section volume.

4 Claims, 3 Drawing Sheets

PRECAST CONCRETE STRUCTURE HAVING LIGHT WEIGHT ENCAPSULATED CORES

FIELD OF THE INVENTION

This invention relates generally to a precast concrete bridge system that is made up of a plurality of sections, and specifically to a concrete bridge system for maximizing a waterway opening while at the same time minimizing the weight of the structure without sacrificing strength.

BACKGROUND OF THE INVENTION

As described in U.S. Pat. No. 4,564,313, precast structures for use in bridge systems are presently in use which permit safe passage of motor vehicles and the like over waterways, such as culverts, creeks and the like. The bridge is precast in sections wherein each section includes a horizontal deck wall that spans between a pair of vertically disposed legs or side wall supports that are integrally cast with the deck. The sections are placed in a side-by-side relationship upon suitable footings and the completed decking is then paved to complete the structure. The size of each section making up the entire concrete bridge structure is generally limited by the weight of the section that can be safely and legally transported from the casting site to the installation site. As a result of this size limitation, the length of the span that can be achieved by the finished structure is correspondingly limited.

A similar precast bridge is disclosed in U.S. Pat. No. 4,993,872. The precast sections, in this case, contain an arched deck wall having a radius of curvature of between twenty five and forty feet. The arch increases the difficulties involved in lifting, hauling and erecting the sections and results in a loss of waterway openings in the final structure.

SUMMARY OF THE INVENTION

It is therefore an object of the present invention to reduce the weight of precast concrete bridge sections without reducing the load carrying capacity of the sections.

A further object of the present invention is to reduce the difficulties associated with lifting, transporting, and erecting precast bridge sections.

A still further object of the present invention is to provide light weight precast bridge sections that can be more easily transported from the casting site to the erection site.

Another object of the present invention is to reduce the cost of precast bridge sections.

Yet another object of the present invention is to provide bridge sections containing voids in the top deck wall and side walls to reduce the dead load weight of the sections while not adversely effecting the load carrying capacity of the sections.

These and other and further objects of the present invention are attained by a concrete bridge system that contains a series of precast sections. Each section includes a planar horizontally disposed deck wall that is integrally joined to a pair of spaced apart vertically disposed legs or side walls. The deck wall and the side walls each contain a plurality of interior cores cast therein that follow the geometry of the containing wall. The cores constitute between 16 to 35 percent of the volume of each wall and are placed so that the load carrying capacity of the structure is not adversely effected. Reinforcing rods are placed between the voids and the opposed outer surfaces of each wall to further enhance the strength and load carrying capacity of the structure.

BRIEF DESCRIPTION OF THE DRAWING

For a further understanding of these and objects of the invention, reference will be made to the following detailed description of the invention which is to be read in connection with the accompanying drawing, wherein.

DETAILED DESCRIPTION OF THE INVENTION

Figure 1:
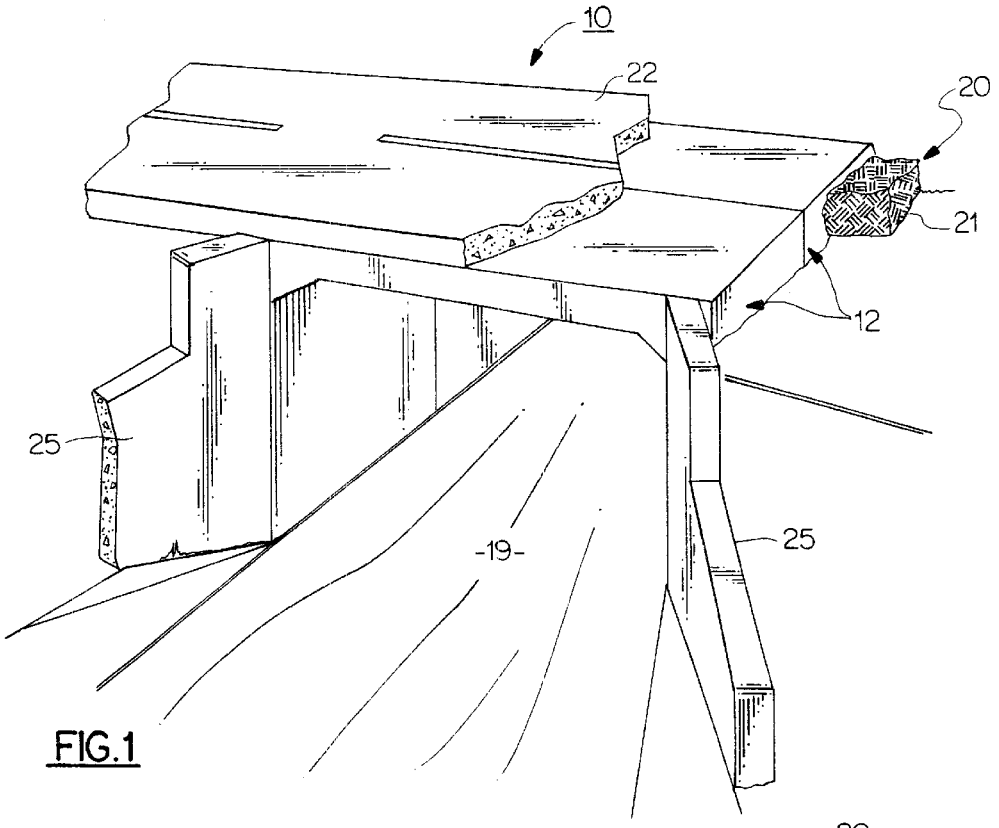
FIG. 1 is a partial perspective view of a bridge system embodying the teachings of the present invention.
Figure 2:
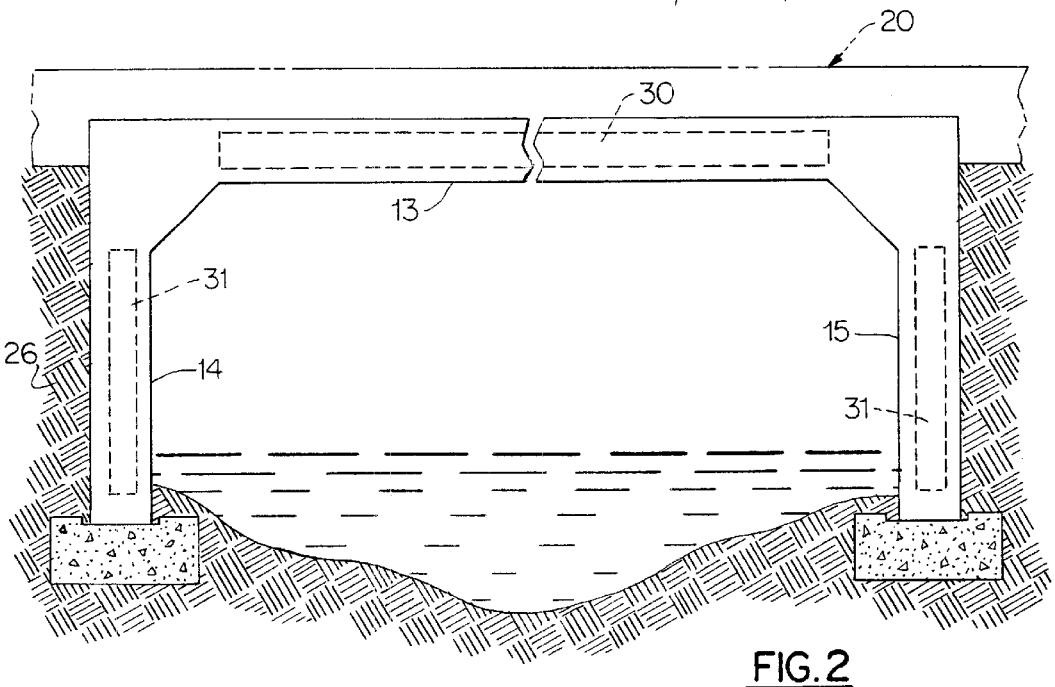
FIG. 2 is a side view of the bridge system shown in FIG. 1 with the wings removed.

Turning now to FIGS. 1 and 2, there is shown a concrete bridge system, generally referenced 10, that embodies the teachings of the present invention. The system is made up of individual precast sections 12. Each section includes a flat horizontally disposed deck wall 13 that is integrally precast with an opposed pair of spaced apart side walls 14 and 15. At the time of erection, to create a channel 10 shaped structure, the side walls of each section are set upon footings 18 situated on either bank of a stream, river, culvert, walkway or the like that the bridge system is designed to span. In this embodiment of the invention, the bridge is shown spanning a relatively wide river 19. Typically, a roadway 20 for vehicular or pedestrian traffic is laid over the combined deck walls of the system. The roadway is typically made up of a bottom layer of soil 21 and a top layer of asphalt or concrete 22. The entrance and exit to the bridge system may be equipped with precast wings 25 for holding back soil in these regions and, in waterway applications as depicted herein, for conducting water into and out of the bridge tunnel.

As best illustrated in FIG. 2, the outer surfaces of the sidewalls of each section are backfilled with soil or stone fill 26 which helps to support the sections in assembly and to provide the system with additional strength for supporting vertical loads that are placed on the system by vehicular traffic or the like crossing the bridge. As further illustrated in FIG. 2, the deck wall and sidewalls of each section are provided with a plurality of voids 30 and 31, respectively, which are precast in the walls at the time of manufacture. As will be explained in greater detail below, the cores are generally rectangular in shape and follow the contour of each containing wall. The cores are formed by mounting lightweight foam blocks 32 and 33 (see FIGS. 5 and 6) into the mold forms at the time of casting and pouring the concrete about the blocks to encapsulate the blocks within the walls. The foam material may be polystyrene or any other similar material capable of forming a desired internal core and preventing the concrete from filling the core volume.

Figure 4:
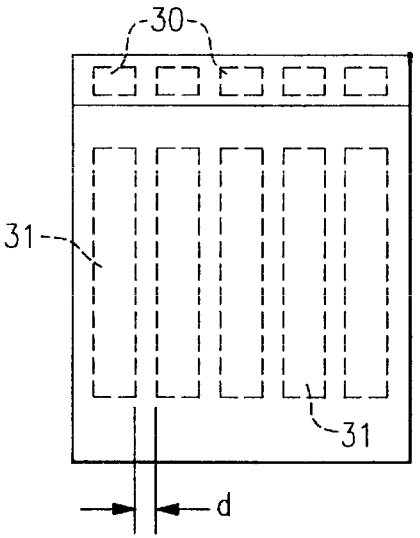
FIG. 4 is an end view of the bridge section shown in FIG. 3.
Figure 3:
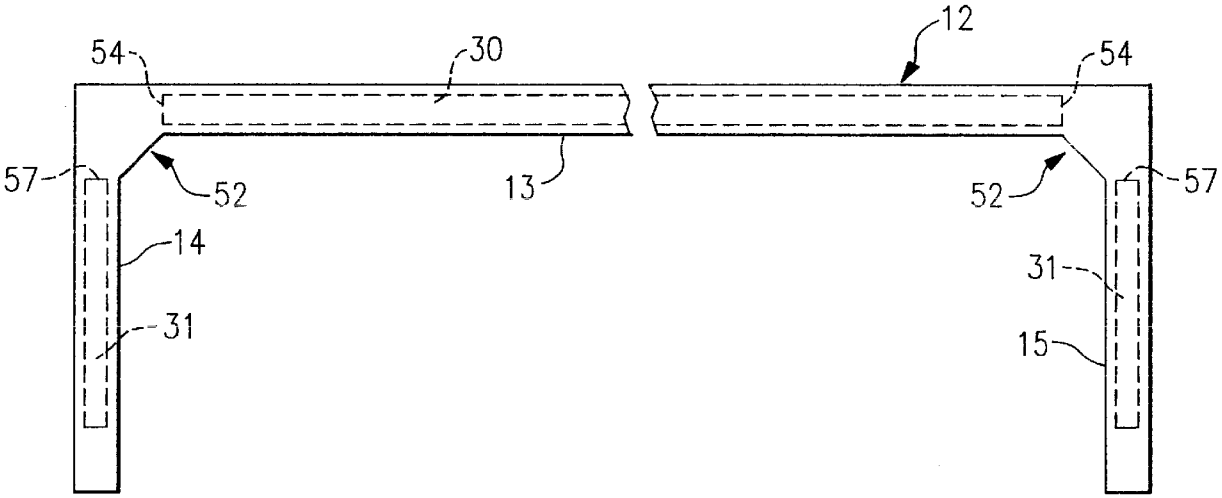
FIG. 3 is a side elevation of a bridge section used in the present system.

Turning now to FIGS. 3 and 4, there is illustrated a bridge section 12 that contains five parallely aligned rectangular cores 40—40 within the opposed side walls. Five rectangular voids 50—50 are similarly cast into the deck wall of the section. Although five cores are employed in the present embodiment of the invention, it should become evident from the disclosure below that the number and shape of the cores can be varied depending upon the length and the width and the thickness of the sections without departing from the teachings of the present invention.

Figure 5:
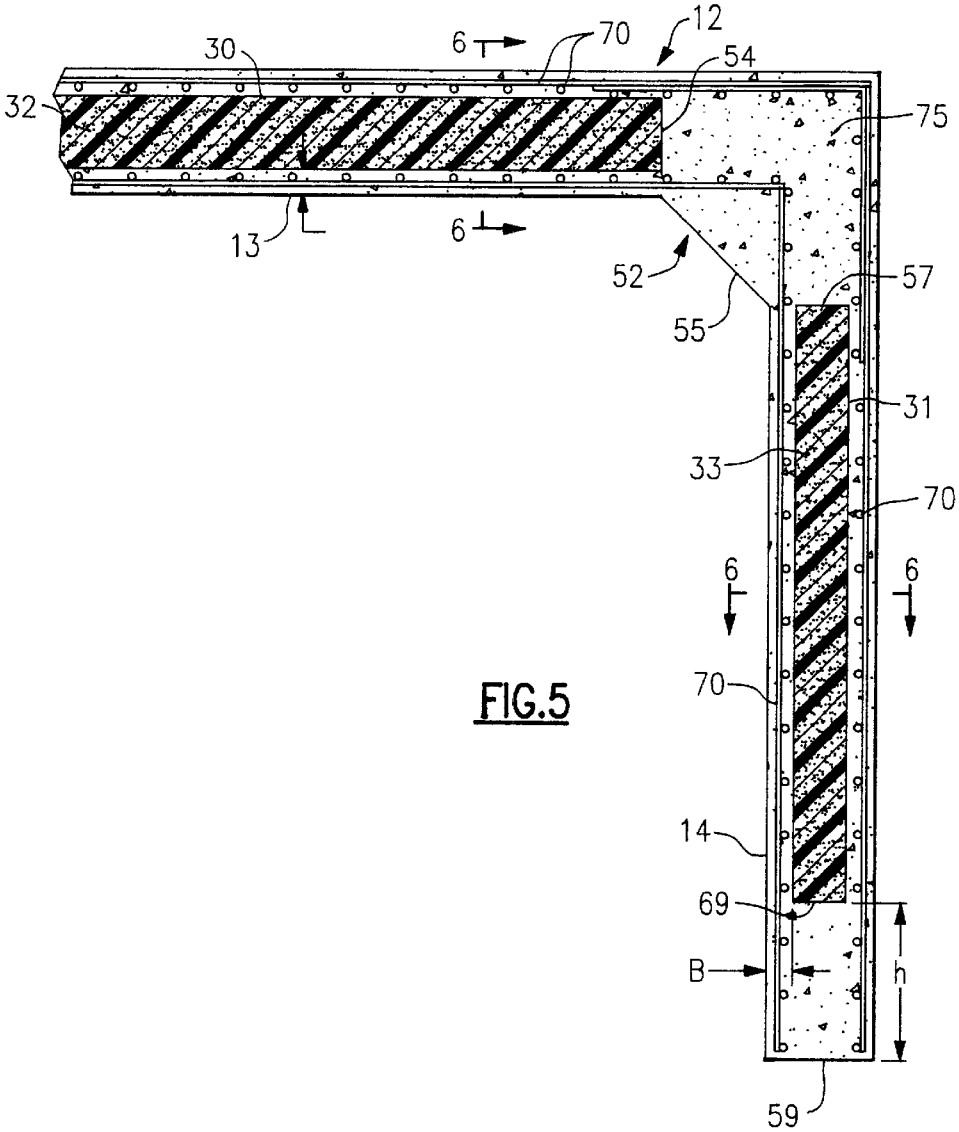
FIG. 5 is an enlarged partial side view in section of a bridge section.
Figure 6:
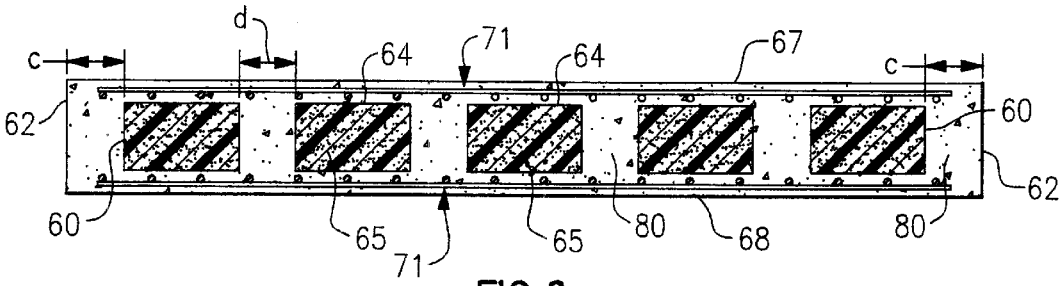
FIG. 6 is a section taken along lines 6—6 in FIG. 5 showing the location of the reinforcing bars and the void contained in the side walls of each bridge section.

FIGS. 5 and 6 further illustrate the construction of section 12. The sidewalls 14 and 15 are cast integrally with the deck wall 13 to form right angle corners with the deck walls. A gusset 52 is cast into the interior corners between the walls. The gusset forms a 45° angle with each of the interior wall surfaces making up each of the corners. Each gusset preferably extends along the width of the section, however, the gusset may be of lesser length or cast in segments along the length of the corners without departing from the teachings of the invention. As best illustrated in FIG. 5, the opposed ends 54 of the cores established in the deck wall terminate at about the point that the inclined wall 55 of each gusset joins the deck wall. Similarly, the top surfaces 57 of the cores contained in the side walls of each section terminate at the. point that the inclined wall of the gusset joins the side wall. Accordingly, the region formed at the corners is completely filled with concrete and reinforced by the gussets to provide high load carrying capacity at the corners.

FIG. 6 is a sectional view taken through either the deck wall 13 or either of the side walls 14 and 15, each section being a mirror image of the other because the overall width across the walls is the same and the location of the voids across the width of the walls is identical. Each parallely aligned core is placed apart from its neighbor a distance (d). The surface 60 of each end core is similarly spaced from the opposed outer surfaces 61 and 62 of the containing wall a distance (c). Preferably, the spacing (c) is about equal to the spacing (d). The outside surfaces 64 and the inside surfaces 65 of the parallely aligned cores are in coplanar alignment and run parallel with the outside surface 67 and the inside surface 68 of each containing wall, respectively. The spacing between the last core in the alignment and the inner or outer wall surface (e) is about one-half that of the spacing (d) separating the cores. As noted above, the cores are suspended in the pouring form and concrete is poured about the voids to completely encapsulate each core creating a Styrofoam block within the precast structure.

As illustrated in FIG. 5, the bottom surfaces 69 of the cores in each side wall alignment contained within the two side walls terminate a height (h) above the distal end face 59 of each side wall. Accordingly, this lower region, as well as the upper region of each side wall, is completely filled with concrete and thus forms top and bottom headers to which the concrete beams 80 running upwardly along the cores are integrally joined at the time of casting. As can be seen, the beams act as support columns in the final structure. As clearly illustrated in FIG. 4, the concrete beams in the side walls are placed in coplanar alignment with the beams 14 of the bridge span to uniformly distribute the load along the beams and translate induced loads efficiently to the footings.

Similarly, the opposed end sections relating to the deck wall are completely filled with concrete to again create end headers in the deck wall to which the horizontal beams running along the cores are also integrally joined. In this case, the elongated beams act as joists in the deck wall. The concrete columns and joist act in the same manner as similar structural elements found in wooden or steel structures to provide the required strength while considerably reducing the weight of the structure.

Reinforcing bars 70 are contained in each of the walls with the bars extending across the length and width of the containing wall. The bars are laid down to form a square pattern grid 71 and are tied together in a manner that is well known in the art. The grids are positioned in assembly on either side of the core alignment adjacent to the inside and outside wall surfaces 67 and 68 as shown in FIGS. 5 and 6. The grids in the sidewalls are cojoined with those in the deck wall in each corner region 75.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. A concrete bridge system that contains a series of precast sections wherein each section further includes a planar horizontally disposed load bearing concrete deck wall, a pair of vertically disposed spaced apart concrete end walls integrally joined to the load bearing deck wall, each of said walls containing a plurality of light weight cores encapsulated therein, the cores in each wall being spaced apart laterally to establish a series of parallel concrete beams that are connected at one end by a first concrete header and at the other end by a second concrete header so that the beams in said side walls are in coplanar alignment with the beams in said deck wall whereby a load exerted on a deck beam is transferred directly to a coplanar aligned beams in each of the side walls, said cores constituting between 16 and 35 percent of the total volume of the section.

2. The system of claim 1 wherein the cores are fabricated of polystyrene.

3. The system of claim 2 that further includes reinforcing bars embedded within the beams and headers.

4. The system of claim 3 wherein said reinforcing bars extend into corner regions between the walls and the bars of one wall are cojoined with bars of an adjacent wall making up the corner.

* * * * *